US005765333A

United States Patent [19]

Cunningham

[11] Patent Number: 5,765,333

[45] Date of Patent: Jun. 16, 1998

[54] UNITIZED POST AND PANEL BUILDING SYSTEM

[76] Inventor: Dale W. Cunningham, P.O. Box 1996, Shelton, Wash. 98584

[21] Appl. No.: 627,884

[22] Filed: Apr. 3, 1996

[51] Int. Cl.[6] ..... E04C 2/34

[52] U.S. Cl. ..... 52/481.1; 52/281; 52/295; 52/721.3; 52/301; 52/309.13; 52/309.4; 52/309.16; 52/781.5; 52/404.1; 52/436

[58] Field of Search ..... 52/293.3, 281, 52/295, 481.1, 721.3, 301, 309.13, 309.4, 405.1, 309.12, 429, 721.4, 309.8, 309.9, 309.7, 406.1, 309.16, 409.1, 436, 437, 438, 723.1, 733.2, 586.1, 270, 781.5, 761

[56] References Cited

U.S. PATENT DOCUMENTS

| | | | |
|---|---|---|---|
| 2,038,615 | 4/1936 | Underdown | 52/281 X |
| 2,269,018 | 1/1942 | Guignon, Jr. | 52/761 X |
| 3,562,985 | 2/1971 | Nicosia | 52/309.8 X |
| 3,683,577 | 8/1972 | Spillman | 52/281 X |
| 3,826,056 | 7/1974 | Smith et al. | 52/761 X |
| 4,070,844 | 1/1978 | Elze | 52/281 |
| 4,269,006 | 5/1981 | Larrow . | |
| 4,638,615 | 1/1987 | Taylor | 52/733.2 X |
| 4,878,329 | 11/1989 | Pawski | 52/761 X |
| 5,007,222 | 4/1991 | Raymond | 52/586.1 |
| 5,181,353 | 1/1993 | Harrington, Jr. | 52/281 X |
| 5,394,665 | 3/1995 | Johnson | 52/733.2 X |
| 5,417,023 | 5/1995 | Mandish | 52/481.1 X |
| 5,475,961 | 12/1995 | Menchetti | 52/481.1 |

FOREIGN PATENT DOCUMENTS

| | | | |
|---|---|---|---|
| 103176 | 12/1941 | Sweden | 52/281 |

*Primary Examiner*—Carl D. Friedman
*Assistant Examiner*—W. Glenn Edwards
*Attorney, Agent, or Firm*—R. Reams Goodloe, Jr.

[57] ABSTRACT

A high strength insulated building structure. The building structure uses a rigid foam building panels having kerfs on each side. The kerfs on the rigid foam building panels are complementary in shape to pre-cured jacketed concrete posts. The pre-cured jacketed posts have a mounting attachment foot adapted for mounting on a substructure, and the building panels are securely and sealingly mounted between adjacent, substructure secured, jacketed concrete posts. The jacketed concrete posts are also provided with top attachment members which are secured to beams which run horizontally above the rigid building panels. The building panels are also provided with furring strips recessed to be flush with their interior and exterior surface, for permitting fasteners to be used for fastening other structural components thereto, such as gypsum board on the interior and siding on the exterior. The building structure provides a high strength, highly insulating structure with quick building time in the field.

31 Claims, 5 Drawing Sheets

UNITIZED POST AND PANEL BUILDING SYSTEM

BACKGROUND

1. Field of Invention

This invention relates to building construction materials, components and systems specifically wall systems, components, and structural supports used in all types of housing and buildings.

2. Description of Prior Art

Houses and other buildings are constructed using many different types of materials and methods of construction to provide enclosure, insulation, and structural integrity.

Past methods of construction used native materials to provide shelter from the elements. With the development of modern civilizations these structures have become more elaborate with construction materials being manufactured such as brick, tile, glass, plywood, and fiberglass insulation. Often these materials are produced in standard units to be cut, mortared, nailed or fastened together to construct houses and buildings for enclosure, insulation, and structural integrity. Manufactured or prefabricated houses and buildings have become a common method of construction where the building is produced in a factory and then transported in one or more large sections to be joined together at the building site. An alternative method is where the components are manufactured, transported to the building site for assembled as if putting together a three dimensional jigsaw puzzle.

The prior art most closely related to this innovation include the following.

The stress skin foam panels, and other foam panel building systems, U.S. Pat. Nos. 4,163,349, 4,269,006 and 5,181,353 uses expanded polystyrene foam sandwiched between oriented strand board or overlapping skins to create walls, floors, ceilings and roof components. Insulation is provided by the incorporated expanded polystyrene core blocks with structural strength provided by a skin over the panels using oriented strand board or similar material. These building systems have three major problems. The panels are usually extremely heavy and may require heavy equipment to erect building on the construction site. The second major problem is that if design changes take place, materials are damaged, or manufacturing errors occur, the builder has to have the new component manufactured and sent from the factory. This is a time loss problem that adds to the cost of construction. A third problem is the difficulty of installing electrical wire and plumbing in the wall behind the oriented strand board skin.

This invention relates to prefabricated construction but where structural components are small enough and light enough to be handled by one or two workers, without need for special material handling equipment, but where the structural components of this innovation are large enough and strong enough to permit quick and easy assemblage of the structure.

A final area of prior art is found in the use of concrete posts used in various applications disclosed in U.S. Pat. Nos. 3,806,562, 4,166,347 4,624,439 4,820,469 4,824,627, and 5,229,051. None have been noted for use as herein described. The jacketed concrete post of this system is a new use and improvement of U.S. Pat. No. 5,229,051 noted above which describes a method of manufacturing a concrete post in a plastic pipe for use as fence posts and similar uses.

OBJECTS AND ADVANTAGES

The objects and advantages of the present invention are:

a) to provide improved strength to the structure by manufacturing a jacketed concrete post which supports high dead load capacity, and which incorporates a special bottom attachment foot and a top attachment bracket which are connected with a stress member such as rebar inside the concrete post to transfer stress loads for connecting the building structure above to the building structure below, including the foundation, by using lag bolts and other mechanical fasteners through the bottom attachment foot and top attachment bracket;

b) to add ductility to the concrete post by wrapping post in a rigid tube and by encapsulating the jacketed post in a kerf on the end of a rigid foam panel;

c) to provide an extremely strong wall between the jacketed posts by using a solid rigid foam panel with a thickness equal to or exceeding the thickness of the jacketed post, with each panel locked between the adjacent posts by the end kerfs, and with adhesive sealant;

d) to provide a solid wall of rigid foam between posts (except for windows, vents and door openings) which absorbs wind shear, earthquake and other forces, to mitigate and prevent the possible domino collapse of wall;

e) to provide a solid wall which incorporates the use of rigid foam materials which have a higher insulating value than standard fiberglass insulation used in conventional construction for the same thickness of wall;

f) to provide a unitized wall system in which the top of each post is connect to adjacent posts with a structural component such as a beam, using the top attachment bracket of posts and mechanical fasteners such as nails and screws, and using adhesive sealant to connect and seal the top of rigid foam panel to the bottom of the beam;

g) to provide reduced spread of fire by using a solid rigid foam panel having a class A fire rating, and where the solid wall minimizes the chimney effect created by air passages within the walls when none solid insulation materials are used;

h) to provide a simple method of attaching plaster board on the inside of walls and siding to the outside of wall panels by adhering shear members of sufficient strength and size to sides of the panels and along the tops and bottoms of panels on both sides (the shear members may also be imbedded into the surface of panels) where nails, screws or similar fasteners might be secured to panel, and where the shear members will reduce the pulling out of fasteners from the softer rigid foam;

i) to provide components which are light and easy to assemble, requiring no special heavy equipment to lift components into place;

j) to provide a solid weather and air tight wall requiring no added air infiltration barriers.

DRAWING FIGURES

For a fuller understanding of the true nature and objects of the invention, reference should be made to the following;

SUMMARY OF THE INVENTION

The object of this invention is to simplify construction, control costs, improve structural integrity, to provide a very strong, ridged, semi-lightweight build system, which takes advantage of modern building materials such as extruded polystyrene, plastic PVC pipe, adhesives, and cement to construct buildings in a manor not used before.

The frame structure of the invention contains a round, square or rectangular jacketed tube filled with cement and rebar. The foot of the post has a metal plate mounting bracket which consist of rebar welded to the plate where the tube meets the plate. The rebar is angled toward the center of the post to insure alignment while increasing the integrative of the concrete post. The plate has holes on the outside edges which are used to secure the post to the sub-floor. The top of the post has a hanger bracket or metal bolt which is implanted into the cement and which is used to secure a beam to the top of the post.

When the posts are erected, foam is set between the post using adhesives which bond the foam to the posts and subfloor. After a number of posts and foam panels are standing in place, a beam of either wood, plastic, metal or composites is fastened in place at the post top and also glued to the top edge of the foam panels. On the interior and exterior of the wall, additional foam panels may be fastened to increase structure strength, integrity and insulating values.

Window and door openings are cut into the foam panels, wrapped with wood, metal or composite framing (bucking) for attachment of doors and windows to the wall system.

Incorporated into the interior and exterior wall panels, are firing strips of wood, metal, plastic or composites for attachment of plasterboard, or siding. These furring strips are also spaced for hanging of heavy items to the wall. By imbedding the furring strips into the foam panels so that they are flush with the wall panel, air channels are eliminated in the wall which decreases the risk of fire spreading by eliminating wall's chimney effect as is present in stud wall construction.

A part of this invention is the ability to cut raceways, for outlets, plumbing and wiring runs. This is accomplished with specially shaped hot knife blades. This process greatly reduces the time and labor needed to plumb and wire a building.

DETAILED DESCRIPTION

Figure 1:
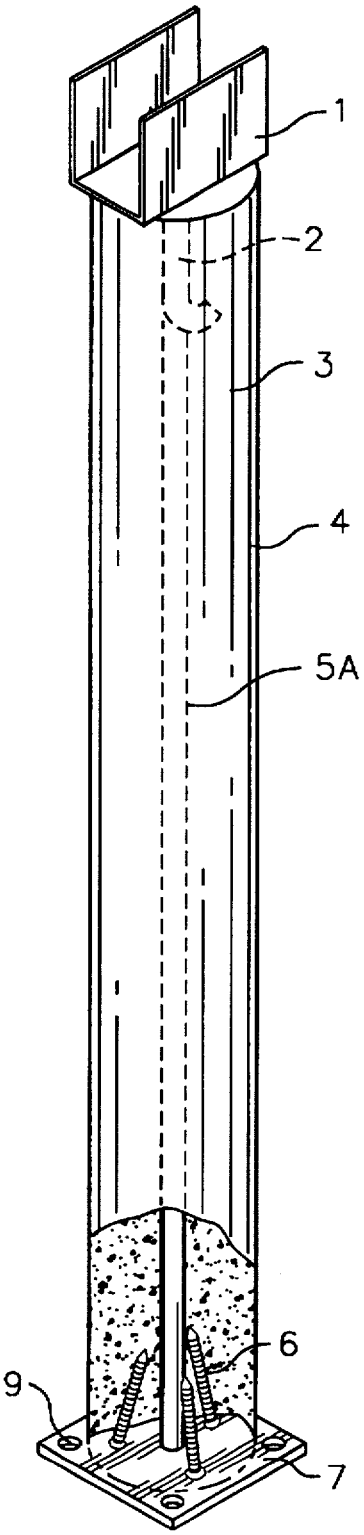
FIG. 1 is the jacketed concrete and rebar filled post with top mounting brackets and a metal foot integrated into the post system.
Figure 2:
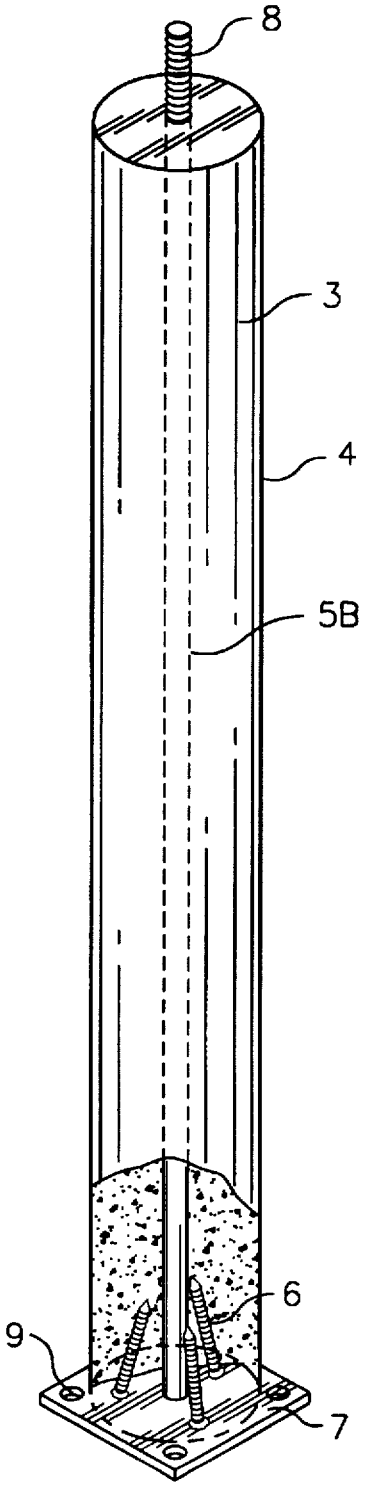
FIG. 2 is option is of attaching through bolt to top of post.
Figure 3:
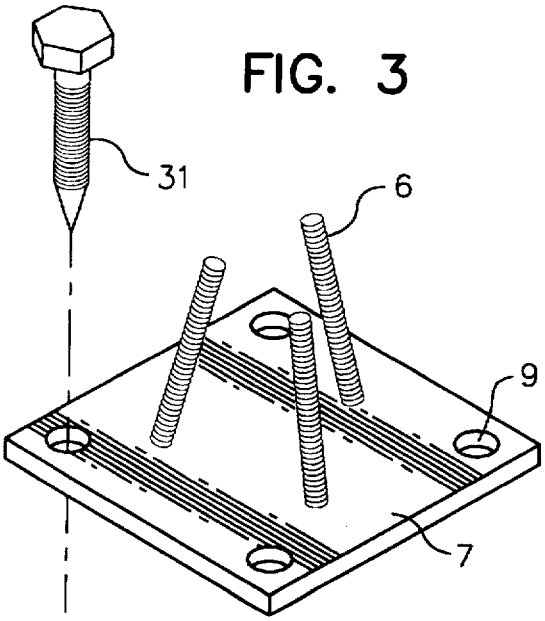
FIG. 3 is the concrete post base attachment foot before it is implanted into the concrete post.
Figure 5:
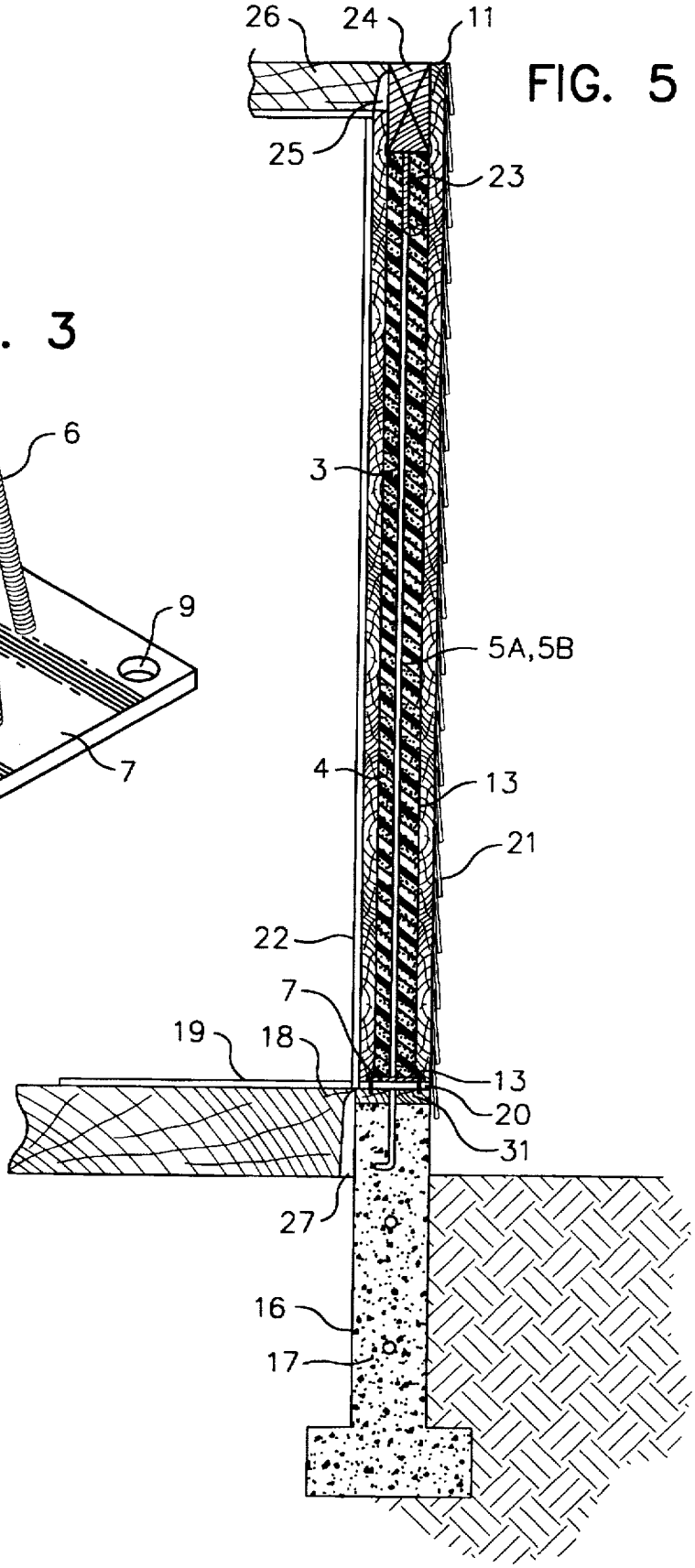
FIG. 5 shows post attached to subfloor with plasterboard (gypsum board) attached on interior wall and siding attached on the outside wall. It also shows beam on top of the post.
Figure 4:
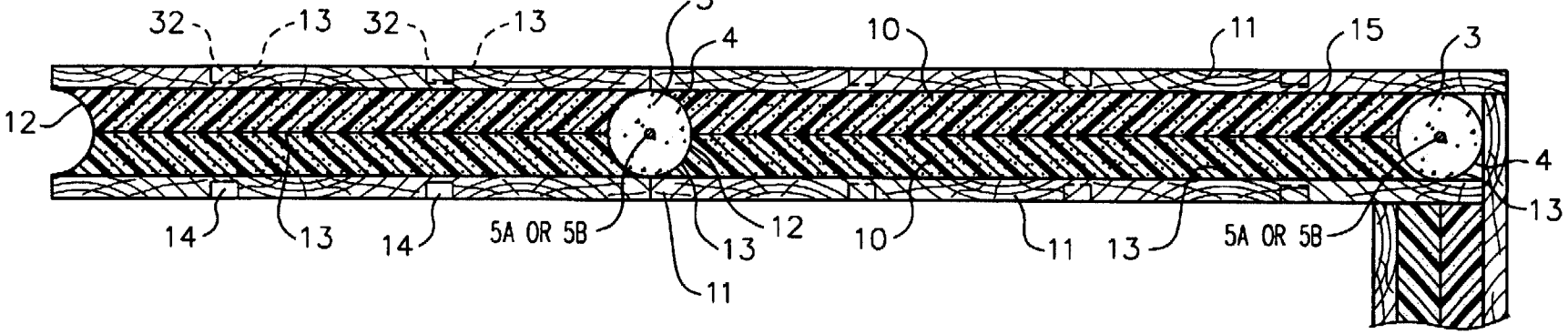
FIG. 4 shows the overhead plan view (birds eye view) looking down at the round posts with rebar and multiple layers of foam (making up panels) and furring strips attached as shear members.
Figure 6:
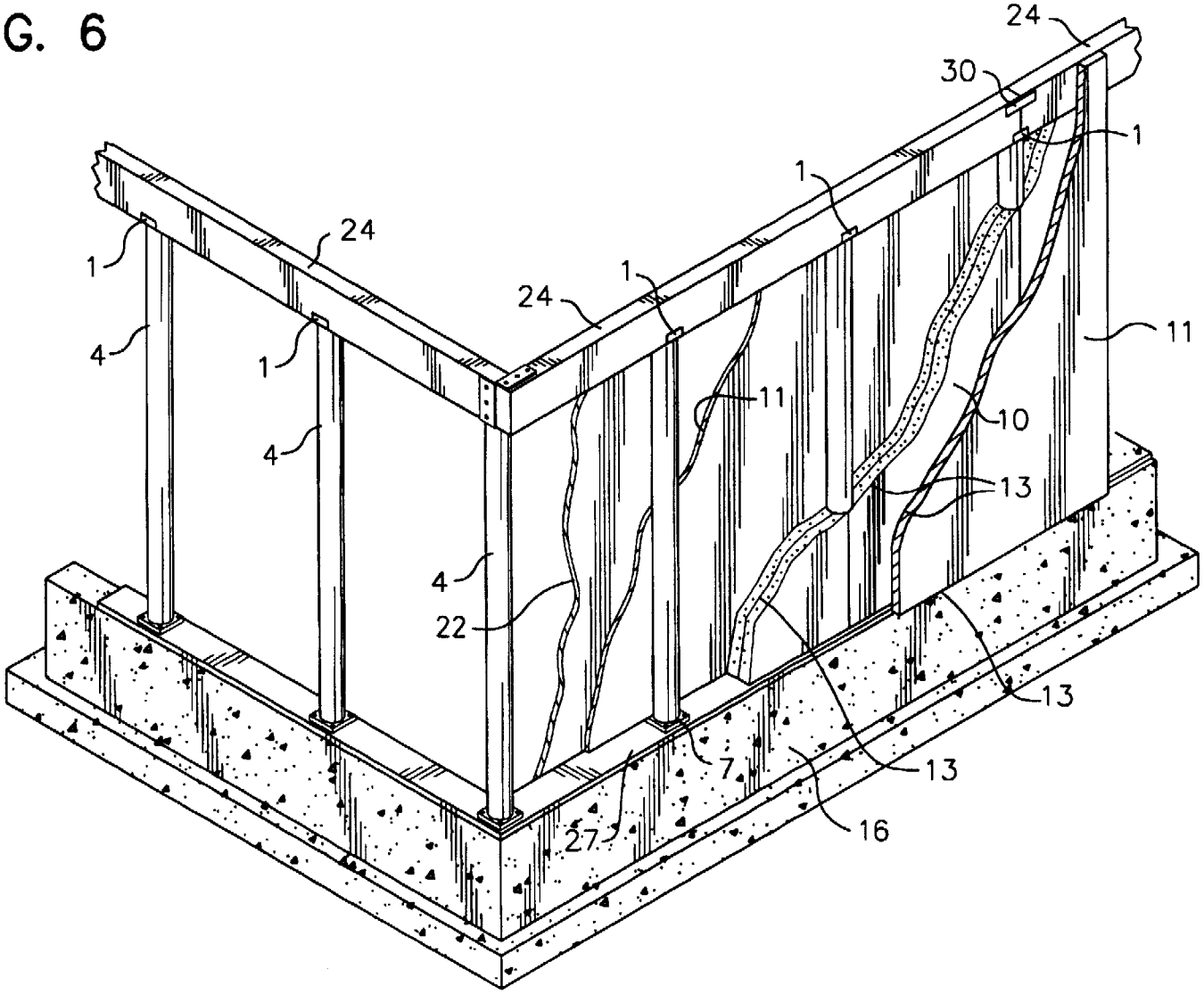
FIG. 6 shows a corner elevation of how posts, beams, and corners are tied together with special engineered corner beam hanger.

The invention and its advantages will become more apparent by reference to the following detailed description and drawings wherein: FIGS. 1 to 9 illustrates the embodiment of the invention. In FIGS. 4 and 6 a concrete slab, or concrete foundation 16, rebar 17, J bolt 23, standard floor system 18, 19 connected to sill plate with hanger 27 hung off foundation 16 used to support the building. FIGS. 1 and 2 are the first components of the invention. The post consists of a tube 4 of PVC, metal, or other composite jacketing material being either round or other shapes, put over a base attachment foot 7 (FIGS. 1, 2, 3, and 6) with welds 15, and rebar 6. Next concrete 3 (FIGS. 1, 2, 4, and 5) or other concrete like substances are poured into the outer jacket 4, with rebar 5A, or 5B centered within, welded to bottom attachment foot 7 and fastener 2 or 8 at top of stress member (rebar) 5A or 5B, and then let to cure and harden.

Figure 9:
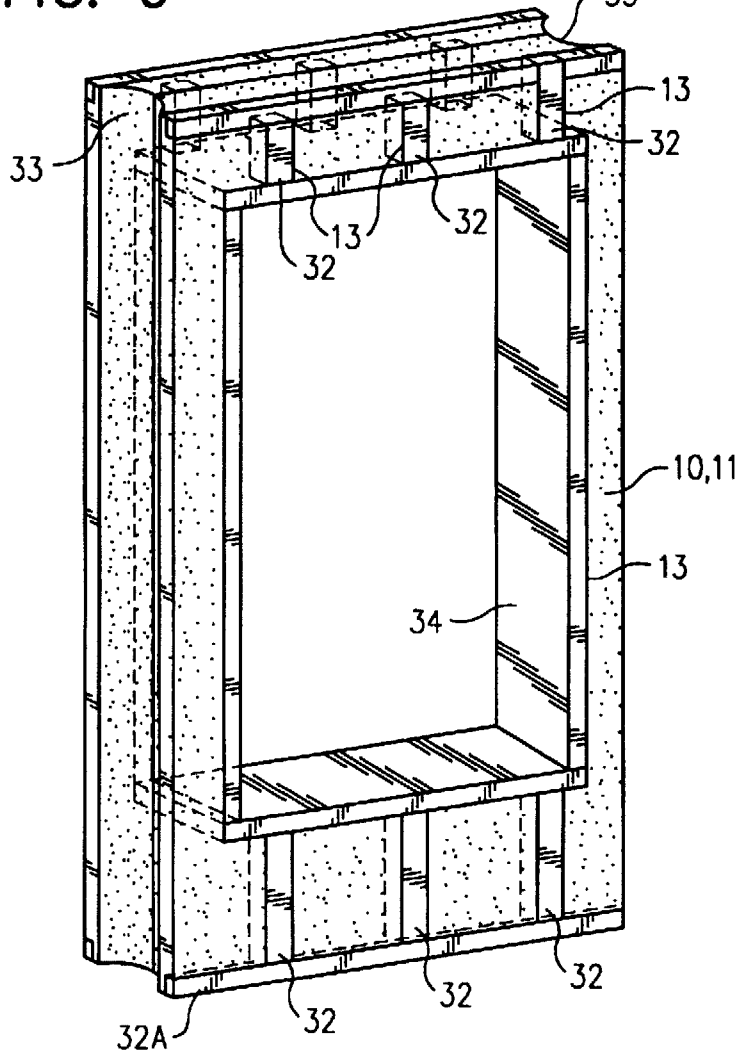
FIG. 9 shows rigid foam panel with edge kerf, shear members (furring strips) and window wrapping (bucking) in place.
Figure 8:
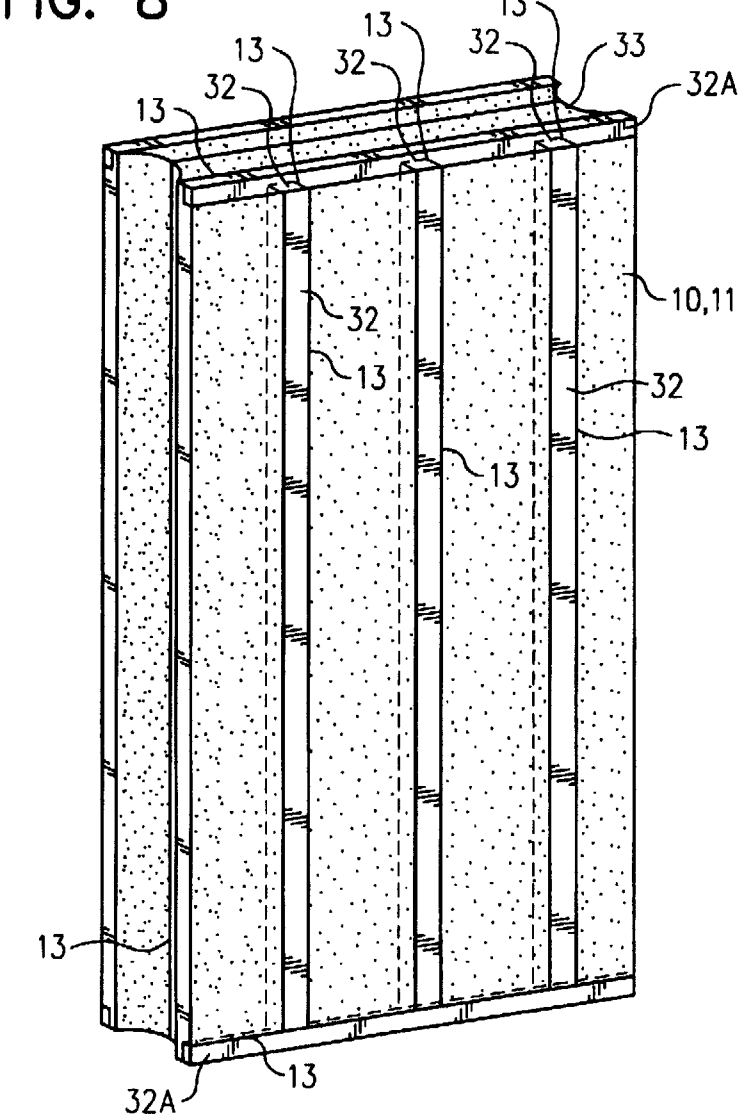
FIG. 8 shows rigid foam panel with edge kerf and showing shear members (furring strips).

The next component of the unitized post, and panel building system is the rigid foam panel. FIGS. 4, 5, 6, 8, and 9 show the panel consisting of one or more layers of rigid foam 10, 11 bonded together using adhesives 13. The panel has a vertical edge kerf 12 which is shaped to mate with the shape of the post (FIGS. 1, 2, 4, 5, and 6) which abuts to panel (FIGS. 4, 5, 6, 8, and 9). In FIGS. 9, window and door openings 33 are cut out and wrapped with wood, metal, or other composite building materials 3, and fastened to the panels with adhesives 13 allowing windows and doors to quickly and precisely be fastened to openings in wall panels using standard fasteners methods. FIGS. 4, shows how channels 14 are cut on exterior and interior surfaces of panel for embedding furring strips 32, 32A (shear members) of wood, metal, or composites into panels using adhesives 13 to permanently affix furring strips 32 and 32A to the panel (FIGS. 4, 5, 6, 8, and 9). The furring strips 32 and 32A are spaced on the surface of panel at distances similar to standard frame walls to allow common attachment of plasterboard 22 on the inside of the panel wall system (FIGS. 4,8,9) or siding 21 on the outside of the panel wall system (FIGS. 4,8,9).

Figure 7:
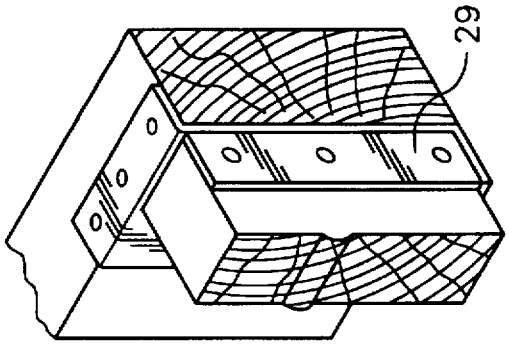
FIG. 7 shows special engineered beam hanger.

To install the unitized post and panel wall system (FIGS. 4,5,6), the first post is placed on the flooring system (FIGS. 5, and 6) starting in a corner over the sill plate 20 and the attachment foot 7 of the post (FIGS. 1,2,3,5,6) is lag bolted 31 through bolt hole 9 attachment foot 7. Next the panel as in FIGS. 4, 5 and 6 is placed next to the post (FIGS. 1,2,4,5,6) The panel (FIGS. 4,5,6,8,9) is bonded onto the post and floor with special adhesives 13. After the panel (FIGS. 4,5,6,8,9) is bonded to the post and floor (FIGS. 5,6) the next post (FIGS. 1,2,4,5) is put in place bolted down using lag bolts 31. It is then bonded to the same panel with special adhesives 13. After a number of the posts (FIGS. 1,2) and the panels (FIGS. 8,9) are standing upright a beam 24 of either wood, metal, or composites is placed on top of the post (FIGS. 5,6,7) fastened at the top of each post using the top attachment bracket I and standard fasteners, with the beam bonded to the panel below using adhesive sealant 13. FIGS. 6 and 7 show the beam 24 at corners is fastened to the abutting beam 24 with special engineered beam holder 29. Where the beam is joined together linearly a standard off the shelf top attachment bracket (connector) 30 is used. Ceiling joist hangers 25 (FIGS. 5) are installed on the beam to carry the ceiling rafters 26 if needed. Foam fillers 28 are used to fill any voids. This process of standing the post (FIGS. 1,2,4,5,6) bolting it down, and bonding the panels (FIGS. 4,5,6,8,9) in place sequentially and then affixing beam to posts with fasteners and panels with adhesive sealant following the foundation edge continues until the last panel mates with the first post at the starting corner, and the last beam above is connected to starting beam.

REFERENCE NUMERALS IN DRAWINGS 1. top attachment bucket
2. j bolt 3. concrete in post
4. PVC pipe
5. rebar 5*a*. standard rebar in post 5*b*. rebar with top thread
6. foot rebar
7. base attachment foot
8. optional rebar with top threads
9. hole in foot
10. foam
11. optional foam laminate
12. half round kerf
13. adhesive
14. channels for furring
15. weld
16. foundation concrete
17. foundation rebar
18. floor joist
19. sub floor
20. sill plate
21. siding
22. plasterboard (gypsum board)
23. j bolt in foundation
24. beam
25. ceiling joist hanger
26. ceiling rafter or joist
27. floor joist hanger
28. foam corner fillers
29. corner beam hangers
30. off the shelf connectors
31. lag bolts
32. vertical furring strips (shear members)
33. window or door wrapping (bucking, shear member)

I claim:

1. A high strength insulated building structure, said building structure comprising:

(a) at least two pre-cured vertical posts, each of said vertical posts comprising:
(i) an upper end;
(ii) and a lower end, said lower end further comprising an attachment foot;
(iii) a peripheral encapsulating jacket;
(iv) a pourable, curable, high compressive strength structural filler;

(b) at least one high compressive strength foam first building panel, said first building panel comprising:
(i) a top,
(ii) a bottom,
(iii) an interior side,
(iv) and an exterior side,
(v) a first edge and a second edge, said first and said second edge each further comprising a vertically extending kerf, said vertically extending kerf complementary to the shape of said peripheral encapsulating jacket of said vertical posts, and (c) wherein said first building panel is securely and sealingly located between two of said vertical posts.

2. The building structure as set forth in claim 1, wherein said at least one first building panel is adhesively bonded to each of said vertical posts.

3. The building structure as set forth in claim 1, wherein said at least one first building panel further comprises two or more channels in said interior side, each of said two or more channels adapted to receive in a tight fitting relationship at least one furring strip.

4. The building structure as set forth in claim 3, wherein said at least one first building panel further comprises a furring strip located in each of said two or more channels.

5. The building structure as set forth in claim 4, wherein each of said furring strips extend vertically, substantially from said bottom to said top of said at least one first building panel.

6. The building structure as set forth in claim 4, wherein at least one of said furring strips extends horizontally at the bottom interior of said at least one first building panel.

7. The building structure as set forth in claim 4, wherein at least one of said furring strips extends horizontally at the top interior of said at least one first building panel.

8. The building structure as set forth in claim 4, wherein at least one of said furring strips extends horizontally at the top exterior of said at least one first building panel.

9. The building structure as set forth in claim 4, wherein at least one of said furring strips extends horizontally at the bottom exterior of said at least one first building panel.

10. The building structure as set forth in claim 1, wherein each of said vertically extending kerfs in said at least one first building panel is substantially shaped, in horizontal cross section, to provide a surface that is complementary to at least a segment of a cylindrical surface.

11. The building structure as set forth in claim 10, wherein each of said vertically extending kerfs in said at least one first building panel is substantially shaped, in horizontal cross section, to provide a surface that is complementary to a half cylinder.

12. The building as set forth in claim 1, wherein said vertically extending kerfs of said at least one first building panel each comprise smooth curves, and wherein each of said vertical posts comprise a smooth curved shape complementary to said kerf shape of said at least one first building panel.

13. The building structure as set forth in claim 1, wherein said at least one first building panel comprises a rigid foam.

14. The building structure as set forth in claim 13, wherein said rigid foam comprising said at least one first building panel has a class A fire rating.

15. The building structure as set forth in claim 1, wherein said at least one first building panel comprises extruded polystyrene.

16. The building structure as set forth in claim 1, said building structure further comprising:

(a) a substructure, said substructure adapted to receive fasteners therein, and (b) fasteners, said fasteners adapted to securingly penetrate into said substructure, and (c) wherein said fasteners are adapted to be affixed to said attachment foot and to said substructure, so as to securely affix said vertical post to said substructure.

17. The building structure as set forth in claim 1, wherein said vertical posts are generally circular in horizontal cross section.

18. The building structure as set forth in claim 1, wherein said at least one first building panel is affixed to each of said vertical posts with a sealing adhesive.

19. The building structure as set forth in claim 1, further comprising (a) one or more beams, said beams adapted to be mounted horizontally above said at least one building panel, and (b) wherein each of said vertical posts further comprise a top attachment member, and (c) wherein said top attachment member is adapted to secure at least one of said one or more beams, so as to tie an upper end of a first of said two or more vertical posts to an upper end of a second of said two or more vertical posts.

20. The building structure as set forth in claim 1, further comprising a second building panel, said second building panel comprising a set of window defining shear members transversely extending through said second building panel.

21. The building structure as set forth in claim 1, wherein said at least one first building panel further comprises at least one interior edge wall defining a raceway, said raceway adapted to receive utilities.

22. The building structure as set forth in claim 1, wherein said peripheral encapsulating jacket comprises a rigid tube.

23. The building structure as set forth in claim 22, wherein said peripheral encapsulating jacket comprises a plastic pipe.

24. The building structure as set forth in claim 23, wherein said plastic pipe comprises a polyvinylchloride.

25. The building structure as set forth in claim 1, wherein said pourable, curable, high compressive strength structural filler comprises cement.

26. The building structure as set forth in claim 1, wherein said vertical post further comprises a longitudinal reinforcing member located along the centerline thereof.

27. The building structure as set forth in claim 26, wherein said longitudinal reinforcing member of said vertical post is affixed to said attachment foot, so as to secure said vertical post to said substructure.

28. A method of building a high strength insulated building structure, said method comprising:

(a) providing at least two pre-cured vertical posts, each of said vertical posts comprising:
  (i) an upper end;
  (ii) and a lower end, said lower end further comprising an attachment foot;
  (iii) a peripheral encapsulating jacket;
  (iv) a pourable, curable, high strength filler;

(b) providing at least one high compressive strength foam first building panel, said first building panel comprising:
  (i) a top,
  (ii) a bottom,
  (iii) an interior side,
  (iv) and an exterior side,
  (v) a first edge and a second edge, said first and said second edge each further comprising a vertically extending kerf, said vertically extending kerf complementary to the shape of said peripherally encapsulating jacket of said vertical posts, and (c) mounting said first building panel securely and sealingly between two of said vertical posts.

29. The method as set forth in claim 28, said method further comprising adhesively bonding said first building panel to each of said vertical posts.

30.The method as set forth in claim 28, said method further comprising the step of providing, in said at least one first building panel, two or more channels, each of said channels adapted to receive in a tight fitting relationship a furring strip.

31. The method as set forth in claim 28, said method further comprising the steps of:

(a) providing one or more beams, said beams adapted to be mounted horizontally above said at least one building panel, and (b) providing, in each of said vertical posts, a top attachment member, and (c) securing at least one of said one or more beams at
  (i) a top attachment member at a first of said two or more vertical posts, and
  (ii) a top attachment member at a second of said two or more vertical posts, (d) so as to secure the beam to the top of said first building panel.

* * * * *